US010707008B2

(12) United States Patent
Shirouzu

(10) Patent No.: US 10,707,008 B2
(45) Date of Patent: Jul. 7, 2020

(54) IRON CORE INCLUDING FIRST IRON CORE BLOCK AND SECOND IRON CORE BLOCK

(71) Applicant: FANUC CORPORATION, Yamanashi (JP)

(72) Inventor: Masatomo Shirouzu, Yamanashi (JP)

(73) Assignee: FANUC CORPORATION, Yamanashi (JP)

( * ) Notice: Subject to any disclaimer, the term of this patent is extended or adjusted under 35 U.S.C. 154(b) by 142 days.

(21) Appl. No.: 15/919,800

(22) Filed: Mar. 13, 2018

(65) Prior Publication Data

US 2018/0268984 A1 Sep. 20, 2018

(30) Foreign Application Priority Data

Mar. 17, 2017 (JP) ..... 2017-053579

(51) Int. Cl.

| | |
|---|---|
| ***H01F 27/28*** | (2006.01) |
| ***H01F 27/26*** | (2006.01) |
| ***H01F 27/34*** | (2006.01) |
| ***H01F 3/10*** | (2006.01) |
| ***H01F 27/38*** | (2006.01) |
| ***H01F 3/14*** | (2006.01) |

(52) U.S. Cl.

CPC ..... *H01F 27/263* (2013.01); *H01F 3/10* (2013.01); *H01F 3/14* (2013.01); *H01F 27/28* (2013.01); *H01F 27/34* (2013.01); *H01F 27/38* (2013.01)

(58) Field of Classification Search

CPC ..... H01F 27/00–36

USPC ..... 336/65, 83, 90, 92, 180–184, 210–215, 336/232–234

See application file for complete search history.

(56) References Cited

U.S. PATENT DOCUMENTS

| | | | | |
|---|---|---|---|---|
| 2,699,532 | A * | 1/1955 | Bussing | H01F 27/245 336/100 |
| 2,862,183 | A * | 11/1958 | Palmer | G01R 11/36 324/137 |
| 2005/0104702 | A1 | 5/2005 | Sano | |
| 2015/0102882 | A1 | 4/2015 | Shudarek | |
| 2016/0125998 | A1 | 5/2016 | Bhide et al. | |

FOREIGN PATENT DOCUMENTS

| | | | |
|---|---|---|---|
| CN | 1617270 | A | 5/2005 |
| CN | 101567249 | A | 10/2009 |
| CN | 204732265 | U | 10/2015 |
| CN | 208173385 | U | 11/2018 |
| GB | 1571057 | A | 7/1980 |
| JP | S51-92622 | U | 7/1976 |
| JP | 59-15363 | A | 1/1984 |
| JP | 59-19457 | A | 1/1984 |
| JP | 2-15301 | A | 1/1990 |
| JP | H2-288315 | A | 11/1990 |
| JP | 2001-230128 | A | 8/2001 |
| JP | 2007-300700 | A | 11/2007 |
| JP | 2015-159657 | A | 9/2015 |
| WO | 2010/119324 | A2 | 10/2010 |

* cited by examiner

*Primary Examiner* — Tuyen T Nguyen
(74) *Attorney, Agent, or Firm* — Hauptman Ham, LLP

(57) ABSTRACT

An iron core includes a first iron core block and a second iron core block disposed so as to create a gap therebetween, and a non-magnetic fastener disposed in the gap. The fastener joins the first iron core block and the second iron core block to each other.

12 Claims, 7 Drawing Sheets

IRON CORE INCLUDING FIRST IRON CORE BLOCK AND SECOND IRON CORE BLOCK

RELATED APPLICATIONS

The present application claims priority to Japanese Application Number 2017-053579, filed Mar. 17, 2017, the disclosure of which is hereby incorporated by reference herein in its entirety.

BACKGROUND OF THE INVENTION

1. Field of the Invention

The present invention relates to an iron core including a first iron core block and a second iron core block.

2. Description of Related Art

In iron cores according to the prior art, a gap member is disposed between a first iron core block and a second iron core block (for example, refer to Japanese Unexamined Patent Publication (Kokai) Nos. 59-15363, 59-19457, and 2-15301).

SUMMARY OF THE INVENTION

Gap members are generally made of resin materials, and therefore have relatively large dimensional tolerances on the order of ±0.1 mm. When a gap between a first iron core block and a second iron core block is of the order of 1 mm to 2 mm, the dimensional tolerance of the gap member has a large effect on the inductance of a reactor having the iron core.

Gap members are often secured to iron core blocks with adhesives or bands. In other words, the gap members are neither directly nor tightly secured to the iron core blocks, and this causes noise or vibration. For the purpose of securing the gap members with bolts or the like, forming through holes in the iron core blocks causes an increase in iron loss.

Therefore, it is desired to provide an iron core that has a reduced effect on inductance, without an increase in noise, vibration, and iron loss.

A first aspect of this disclosure provides an iron core that includes a first iron core block and a second iron core block disposed so as to create a gap therebetween, and a non-magnetic fastener disposed in the gap. The fastener joins the first iron core block and the second iron core block to each other.

According to the first aspect, the fastener that joins the first iron core block and the second iron core block to each other prevents an increase in noise, vibration, and iron loss. Since the iron core blocks need not be machined in a specific manner, an effect on inductance is eliminated.

The above objects, features, and advantages and other objects, features, and advantages or the present invention will become more apparent from the following detailed description of preferred embodiments along with the accompanying drawings.

DETAILED DESCRIPTION OF THE INVENTION

Figure 1:
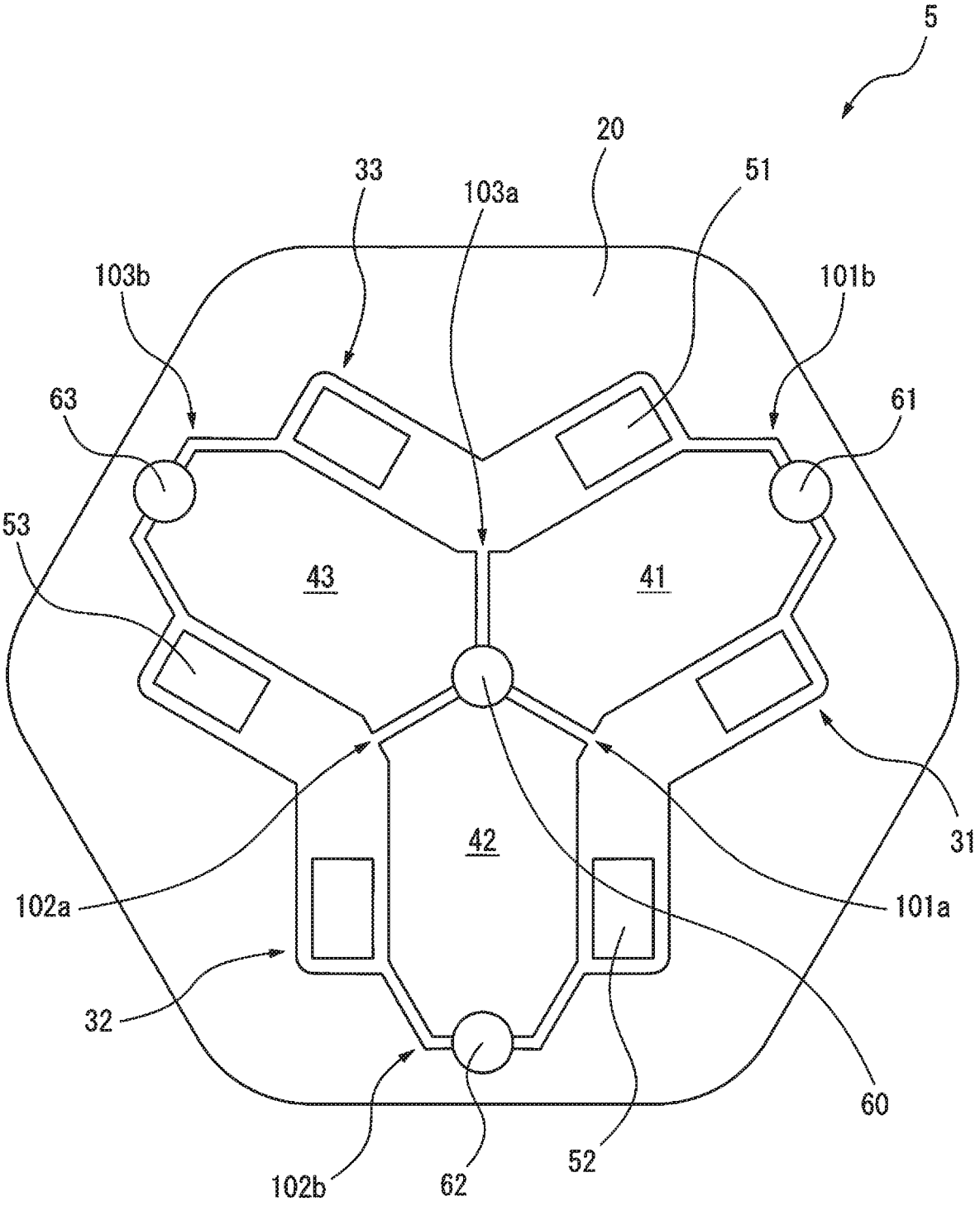
FIG. 1 is a cross-sectional view of a reactor including an iron core according to a first embodiment.

Embodiments of the present invention will be described below with reference to the accompanying drawings. In the drawings, the same reference numerals indicate the same components. For ease of understanding, the scales of the drawings have been modified in an appropriate manner.

FIG. 1 is a cross-sectional view of a reactor including an iron core according to a first embodiment. As shown in FIG. 1, the reactor 5 includes an outer peripheral core 20 having a hexagonal cross-section, and at least three core coils 31 to 33 contacting or connected to an inner surface of the outer peripheral core 20. The outer peripheral core 20 may have a round shape or another polygonal shape.

The core coils 31 to 33 include cores 41 to 43 and coils 51 to 53 wound onto the cores 41 to 43, respectively. Each of the outer peripheral core 20 and the cores 41 to 43 is made by stacking iron sheets, carbon steel sheets, electromagnetic steel sheets, or amorphous sheets, or made of a magnetic material such as a pressed powder core or ferrite. The number of the core coils 31 to 33 may be an integral multiple of 3, and thereby the iron core assembly constituted of the outer peripheral core 20 and the cores 41 to 43 can be used in a three-phase reactor.

Furthermore, the cores 41 to 43 converge toward the center of the outer peripheral core 20 at their radial inner end portions, each having an edge angle of approximately 120°. The radial inner end portions of the cores 41 to 43 are separated from each other by gaps 101*a* to 103*a*, which can be magnetically coupled. In other words, in the first embodiment, the radial inner end portion of the core 41 is separated from the radial inner end portions of the two adjacent cores 42 and 43 by the gaps 101*a* and 103*a*, respectively. The same is true for the other cores 42 and 43.

Furthermore, the cores 41 to 43 have the same dimensions as each other, and are arranged at equal intervals in the circumferential direction of the outer peripheral core 20. In FIG. 1, gaps 101*b* to 103*b* are each formed between the radial outer end portion of each of the cores 41 to 43 and the outer peripheral core 20, so as to be magnetically coupled.

Note that, the gaps 101*a* to 103*a* ideally have the same dimensions, but may have different dimensions. The same is true for the gaps 101*b* to 103*b*. In the embodiments described later, a description regarding the gaps 101*a* to 103*a*, the core coils 31 to 34, and the like may be omitted.

As described above, in the first embodiment, the core coils 31 to 33 are disposed inside the outer peripheral core 20. In other words, the core coils 31 to 33 are enclosed within the outer peripheral core 20. The outer peripheral core 20 can reduce leakage of magnetic flux generated by the coils 51 to 53 to the outside.

Fasteners 61 to 63 are each disposed between each of the cores 41 to 43 and the outer peripheral core 20. The centers of the fasteners 61 to 63 are disposed in the caps 101*b* to 103*b*, respectively. Each of the fasteners 61 to 63 serves to join each of the cores 41 to 43 and the outer peripheral core 20 together.

A fastener 60 is disposed at the center of the reactor 5. The center of the fastener 60 is disposed at the intersection of the gaps 101*a* to 103*a*. The fastener 60 serves to join the cores 41 to 43 to each other. The fasteners are made of a non-magnetic material, e.g., SUS, aluminum, or the like.

Figure 2A:
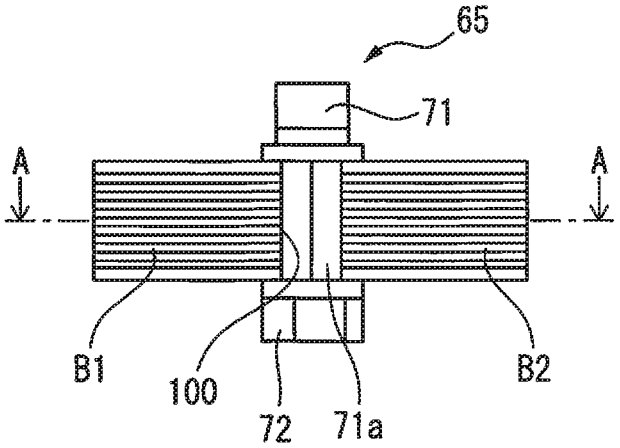
FIG. 2A is a partial enlarged side cross-sectional view of a fastener and the vicinity thereof according to the first embodiment.
Figure 2B:
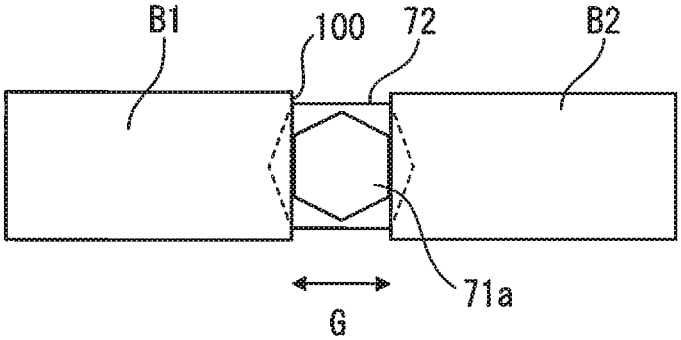
FIG. 2B is a cross-sectional view taken along line A-A in FIG. 2A.

FIG. 2A is a partial enlarged side cross-sectional view of a fastener and the vicinity thereof according to the first embodiment, and FIG. 2B is a cross-sectional view taken along line A-A in FIG. 2A. In the drawings, the fastener 65 joins a first iron core block B1 and a second iron core block B2 to each other. The fastener 65 is a typical example of the fasteners 60 and 61 to 63 (64). The gap 100 is a typical example of the gaps 101*a* to 103*a* (104*a*), and 101*b* to 103*b* (104*b*). FIG. 2B illustrates the gap length G of the gap 100, which corresponds to the distance between the first iron core block B1 and the second iron core block B2.

When the fastener 65 represents the fasteners 61 to 63, the first iron core block B1 corresponds to the outer peripheral core 20, and the second iron core block B2 corresponds to the cores 41 to 43. When the fastener 65 represents the fastener 60, the first iron core block B1 and the second iron core block B2 correspond to the cores 41 to 43.

Figure 2C:
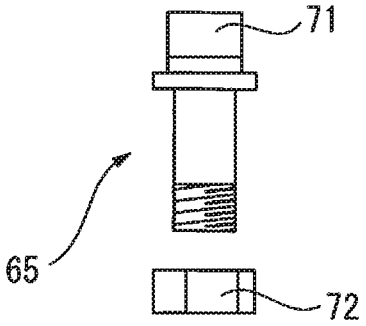
FIG. 2C is a drawing of an example of the fastener.

Furthermore, FIG. 2C is a drawing of an example of the fastener illustrated in FIG. 2A. The fastener 65 illustrated in FIG. 2C is constituted of a bolt 71 and a nut 72. Referring to FIGS. 2A and 2B, the shaft 71*a* is longer than the thicknesses of the first iron core block B1 and the second iron core block B2, and the shaft 71*a* of the bolt 71 has a regular hexagonal cross-section. The shaft 71*a* may have another polygonal cross-section or a round cross-section. Each of the head portion of the bolt 71 and the nut 72 has a larger diameter than the gap length G.

In this instance, after the shaft 71*a* of the bolt 71 is inserted into the gap 100, the nut 72 is screwed onto the bolt 71 on the end opposite to the head. Thus, the fastener 65 firmly joins the first iron core block B1 and the second iron core block B2 to each other. As shown in FIG. 2B, the dimensions of the shaft 71*a* are determined such that the maximum turning radius of the cross-section of the shaft 71*a* is equal to or more than half of the gap length G.

Therefore, once the fastener 65 has joined the first iron core block B1 and the second iron core block B2 to each other, the bolt 71 does not turn in the cap 100. Therefore, even when a device, e.g., a reactor 5, including an iron core constituted of the first iron core block B1 and the second iron core block B2 is driven, no noise or vibration occurs from the first iron core block B1 and the second iron core block B2. Through holes or the like need not be formed in the first iron core block B1 and the second iron core block B2, thus resulting in no increase in iron loss.

Furthermore, since the fastener 65 made of the non-magnetic material firmly joins the first iron core block B1 and the second iron core block B2, a gap member made of a resin material or the like need not be used. Thus, the gap length G of the gap 100 is defined by machining accuracy for machining the iron core blocks B1 and the like and the fastener 65, for example, a dimensional tolerance of the order of ±0.02 mm. Furthermore, the iron core blocks B1 and B2 need not be machined in a specific manner. Therefore, it is possible to eliminate an effect on the inductance of the reactor 5.

When the fastener 65 includes a screw, a bolt, or the like, the fastener 65 can join the iron core blocks B1 and B2 for a longer time than when using an adhesive. Furthermore, since the bolt and the like made of the non-magnetic material hardly interfere with magnetic flux passing through the iron core, the iron core including the iron core blocks B1 and B2 does not grow in size.

Figure 2D:
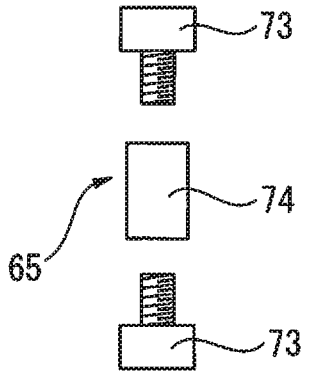
FIG. 2D is a drawing of another example of the fastener.
Figure 2E:
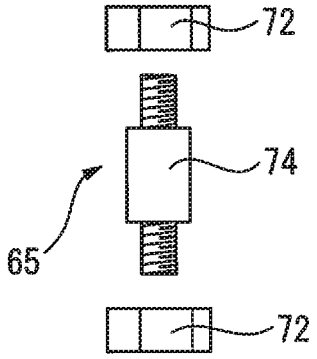
FIG. 2E is a drawing of yet another example of the fastener.

FIGS. 2D and 2E illustrate other examples of the fastener. The fastener 65 illustrated in FIG. 2D is constituted of a rod 74 having inner threads formed in both end surfaces of the rod 74, and two screws 73. The fastener 65 illustrated in FIG. 2E is constituted of a rod 74 having threads protruding from both end surfaces of the rod 74, and two nuts 72. The cross-section of each rod 74 is similar to that of the shaft 71*a* of the bolt 71. In these instances, the fasteners 65 are made of the above-described non-magnetic material. Therefore, the same effects as above can be obtained.

Figure 3:
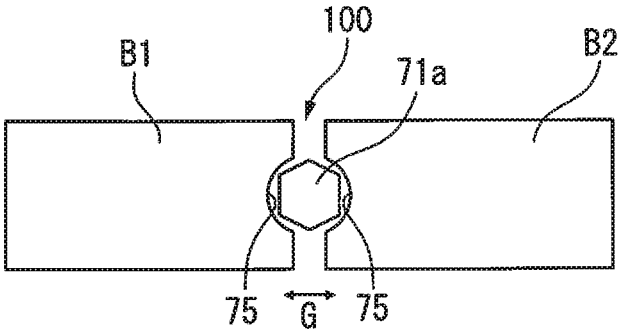
FIG. 3 is a cross-sectional view of an iron core block according to a second embodiment.

FIG. 3 is a top view of an iron core block according to a second embodiment, when viewed in the same manner as FIG. 2B. In FIG. 3, recessed portions 75 are formed in a surface of a first iron core block B1 and a surface of a second iron core block B2 facing a gap 100, into a shape corresponding to the fastener 65. The cross-section of the recessed portion 75 may be in any shape other than a semicircle. The recessed portion 75 may be formed in the surface of only one of the first iron core block B1 and the second iron core block B2.

An existing bolt 71 to be used as the fastener 65 may have unsuitable dimensions for the gap length G. For example, the maximum turning radius of the existing bolt 71, which can be used as the fastener 65, may be larger than a half of the gap length G. In such an instance, a recessed portion 75 may be formed in at least one of a first iron core block B1 and a second iron core block B2, and the existing bolt 71 can be thereby disposed in a gap 100 having the desired gap length G.

In other words, a fastener 65 of desired dimensions can be used, irrespective of the gap length G of the gap 100. The recessed portion 75 preferably has a minimum shape corresponding to the fastener 65, and, as a result, produces a reduced effect on inductance.

Figure 4A:
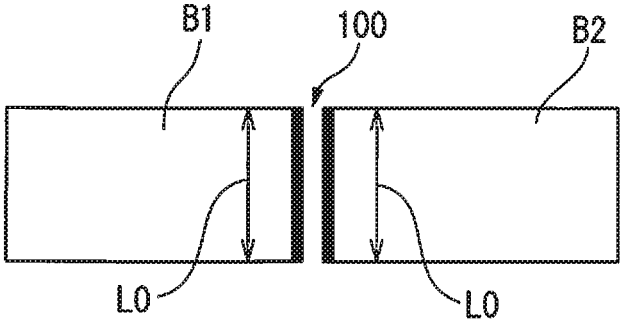
FIG. 4A is a top view of an iron core block according to the prior art.

FIG. 4A is a top view of an iron core block according to the prior art. In FIG. 4A, the thick lines represent the surfaces of the first iron core block B1 and the second iron core block B2 forming the gap 100. When the reactor 5 is driven, the main magnetic flux passes through the surfaces of the first iron core block B1 and the second iron core block B2 represented by the thick lines. However, when the fastener 65 (not illustrated in FIG. 4A) is disposed in the gap 100, the cap 100 is reduced in size by the fastener 65, and hence the size (cross-sectional area) of the gap 100 is reduced with respect to the sizes (cross-sectional areas) of the iron core blocks B1 and B2, through which the main magnetic flux passes.

Figure 4B:
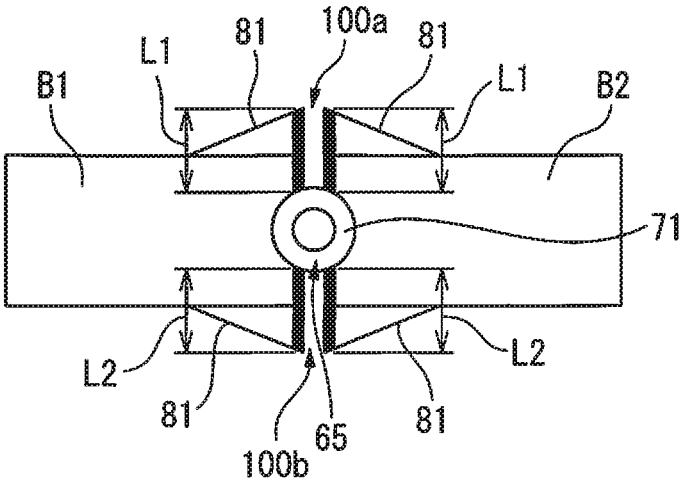
FIG. 4B is a top view of an iron core block according to a third embodiment.

FIG. 4B is a top view of an iron core block according to a third embodiment. In FIG. 4B, gap extension portions 81 are provided on both side surfaces of each of the first iron core block B1 and the second iron core block B2. The gap extension portions 81 are formed on the surfaces of each of the first iron core block B1 and the second iron core block B2 adjacent to the surface forming the gap 100. The gap extension portions 81 serve to extend the gap 100 in part of the iron core blocks B1 and B2. The gap extension portions 81 are preferably formed integrally with the first iron core block B1 and the second iron core block B2.

In FIG. 4B, a fastener 65 disposed in the gap 100 divides the gap 100 into a first gap portion 100*a* and a second gap portion 100*b*. The dimensions of the gap extension portions 81 are determined such that the sum of the dimension L1 of the first gap portion 100*a* and the dimension L2 of the second gap portion 100*b* is equal to the dimension L0 (width) of the gap 100. In FIG. 4B, the gap extension portions 81 have the same dimension as each other.

In other words, the maximum width of the gap extension portions 81 provided on both of the side surfaces of the first iron core block B1 and the like is substantially equal to the sum of the dimension L1 of the first gap portion 100*a*, the dimension L2 of the second gap portion 100*b*, and the diameter of a shaft 71*a* f a bolt 71. Furthermore, the dimensions of the gap extension portions 81 may be different, between one side of the iron core block and the other side thereof, as long as the sum of the dimension L1 of the first gap portion 100*a* and the dimension L2 of the second gap portion 100*b* is equal to the dimension L0 of the gap 100.

As described above, the provision of the gap extension portions 81 can compensate for the reduced size of the gap 100 owing to the disposition of the fastener 65. As a result, the electrical characteristics of the reactor 5 are prevented from changing. In order to obtain desired electrical characteristics, the dimensions of the gap extension portions 81 may be changed.

Figure 4C:
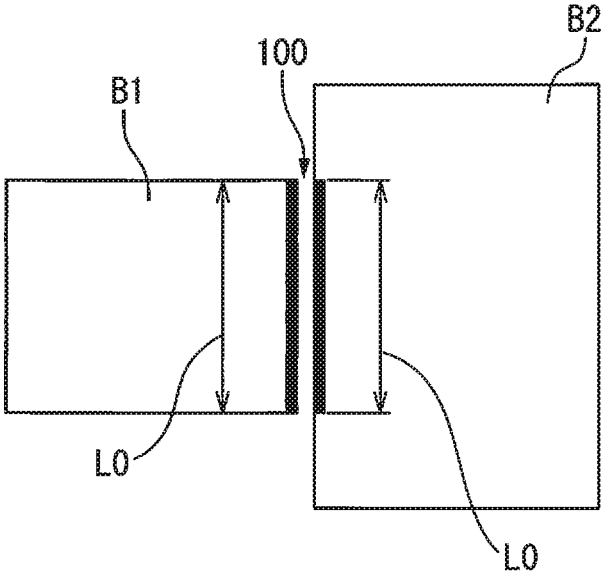
FIG. 4C is a top view of another iron core block according to the prior art.
Figure 4D:
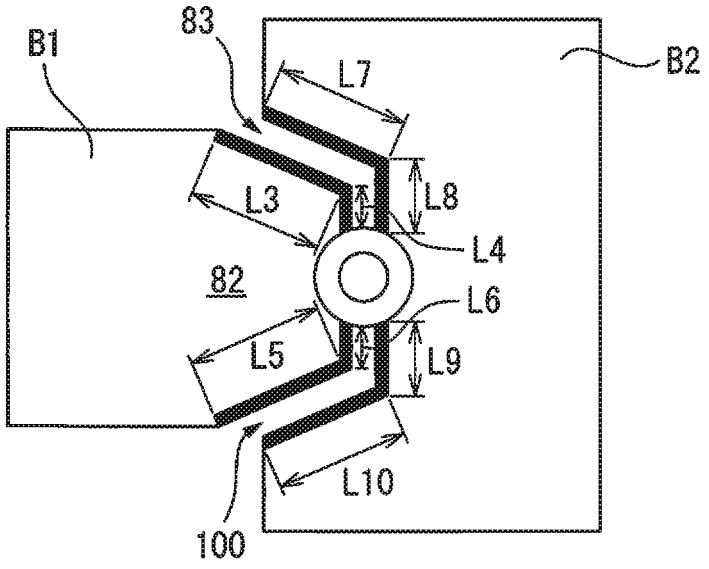
FIG. 4D is a top view of another iron core block according to the third embodiment.

FIG. 4C is a top view of another iron core block according to the prior art. FIG. 4D is a top view of another iron core block according to the third embodiment. In these drawings, the first iron core block B1 is smaller than the second iron core block B2.

In this instance, as shown in FIG. 4D, a smaller first iron core block B1 is partly projected, while a larger second iron core block B2 is partly recessed in accordance with the first iron core block B1. In FIG. 4D, the first iron core block B1 includes a trapezoidal projected portion 82, while the second iron core block B2 includes a trapezoidal recessed portion 83. The trapezoidal projected portion 82 and the trapezoidal recessed portion 83 are examples of the gap extension portion 81. Note that, the trapezoidal projected portion 82 and the trapezoidal recessed portion 83 may be formed in other shapes.

As shown in FIG. 4D, the dimensions of the trapezoidal projected portion 82 are determined such that the sum of the dimensions L3 to L6 of individual parts of the trapezoidal projected portion 82 after a fastener 65 is disposed in a gap 100 is equal to the dimension L0 of a surface of a first iron core block B1 facing the gap 100 illustrated in FIG. 4C. In the same manner, the dimensions of the trapezoidal recessed portion 83 are determined, such that the sum of the dimensions L7 to L10 of individual parts of the trapezoidal recessed portion 83, after the fastener 65 is disposed in the gap 100, is equal to the dimension L0 or part or a surface of a second iron core block B2 facing the gap 100 illustrated in FIG. 4C. In this instance, the same effects as above can be obtained.

Figure 5A:
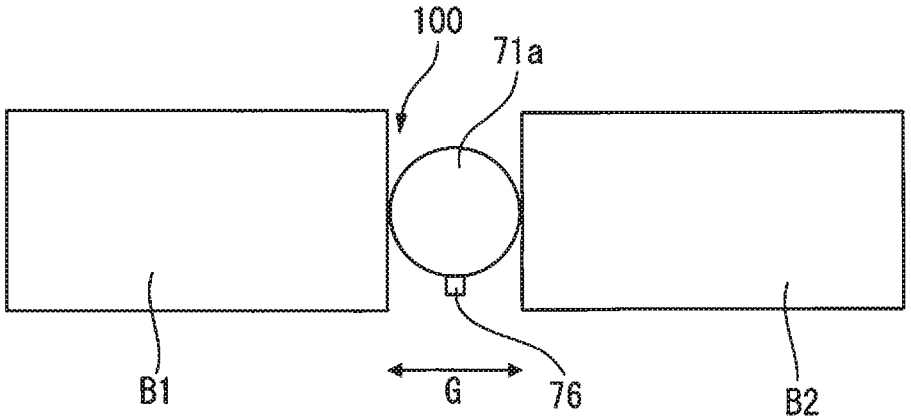
FIG. 5A is a cross-sectional view of an iron core block according to a fourth embodiment.

FIG. 5A is a cross-sectional view of an iron core block according to a fourth embodiment, when viewed in the same manner as FIG. 2B. For ease of understanding, FIG. 5A and FIG. 5B, which is described later, omit a nut 72. In the drawings, the bolt 71 to be used as the fastener 65 is round in cross-section, and has a diameter approximately equal to the gap length G.

In FIG. 5A, a projection 76 is provided in the shaft 71*a* of the bolt 71, as an anti-rotation member. Once the fastener 65 has joined the first iron core block B1 and the second iron core block B2, the bolt 71 of the fastener 65 cannot rotate due to the projection 76. Therefore, the projection 76 prevents the loosening of the fastener 65.

Figure 5B:
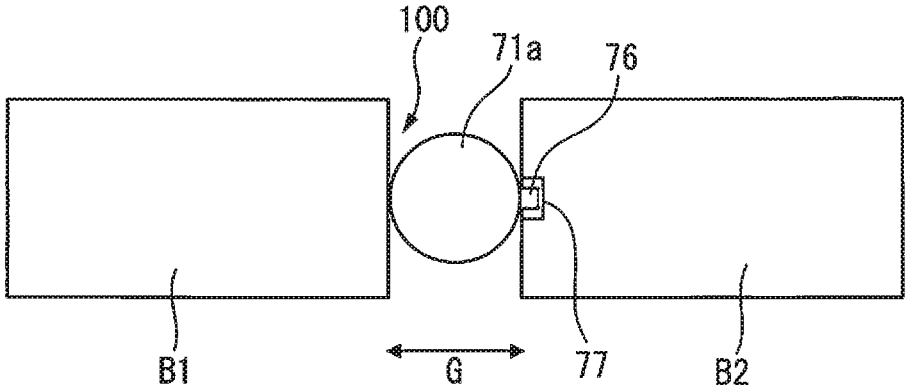
FIG. 5B is another cross-sectional view of the iron block according to the fourth embodiment.

FIG. 5B is another cross-sectional view of the iron block according to the fourth embodiment, when viewed in the same manner as FIG. 5A. In FIG. 5B, a receptacle 77, e.g., a pit, for receiving the projection 76 is formed in the second iron core block B2, in addition to the projection 76 formed in the shaft 71*a* of the bolt 71. In FIG. 5B, both the projection 76 and the receptacle 77 function as anti-rotation members. In this instance, the bolt 71 is disposed in the gap 100 in such a direction that the projection 76 is fitted into the receptacle 77. In this instance, the bolt 71 of the fastener 65 cannot rotate, thus producing the same effects as above.

Though not illustrated, the receptacle 77 may be formed in the shaft 71*a*, while the projection 76 may formed in the second iron core block B2. The fourth embodiment includes instances in which a plurality of anti-rotation members are provided.

Figure 6:
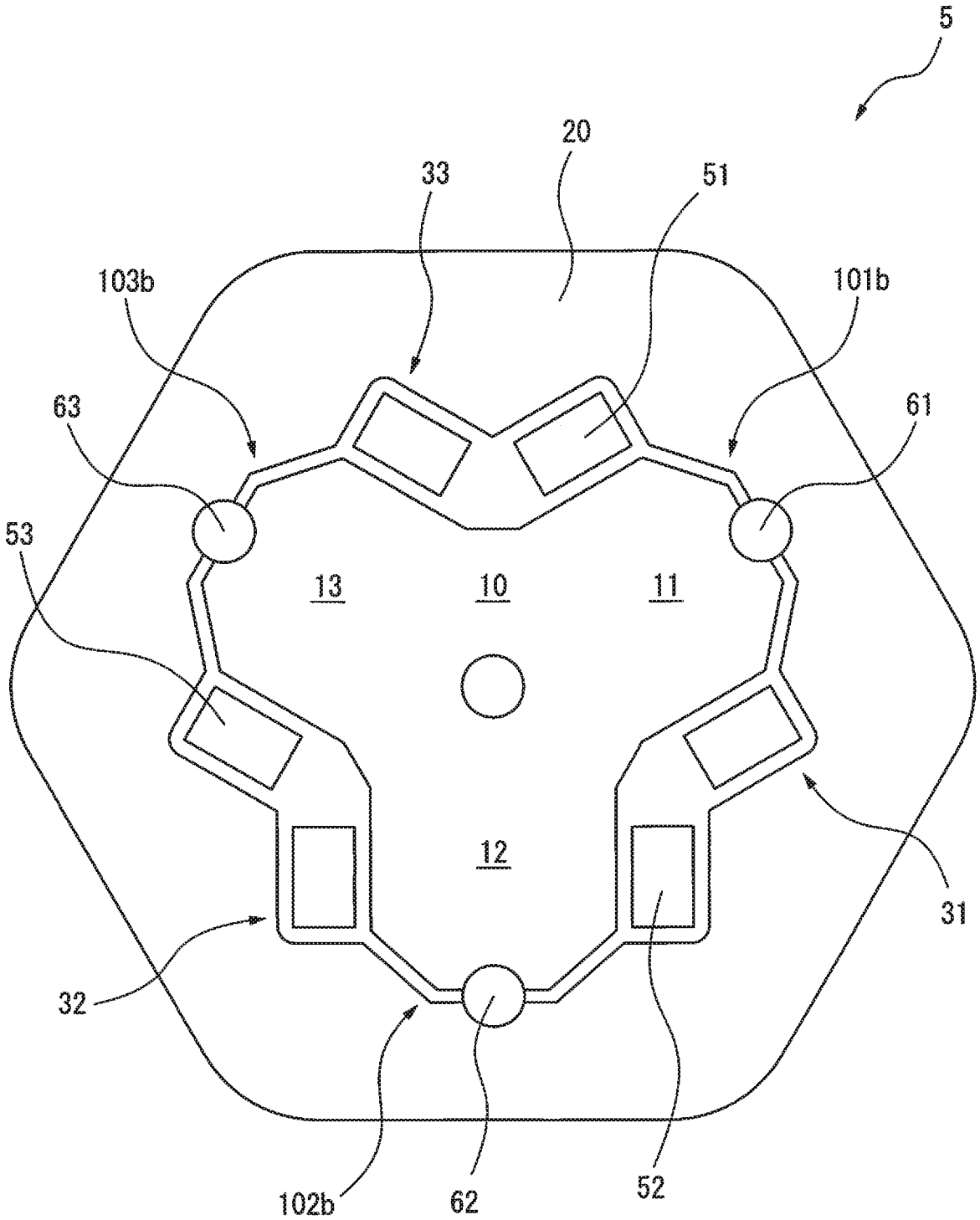
FIG. 6 is a cross-sectional view of another reactor including an iron core.

FIG. 6 is a cross-sectional view of another reactor including an iron core. As shown in FIG. 6, the reactor 5 mainly includes an outer peripheral core 20 and a central core 10 disposed inside the outer peripheral core 20. The central core 10 includes three extension portions 11 to 13 arranged at equal intervals in the circumferential direction. The extension portions 11 to 13 constitute part of the central core 10. In FIG. 6, the extension portions 11 to 13 and coils 51 to 53, which are wound onto the extension portions 11 to 13, constitute core coils 31 to 33, respectively.

Fasteners 61 to 63 are each disposed between each of the extension portions 11 to 13 and the outer peripheral core 20. The centers of the fasteners 61 to 63 are disposed in gaps 101*b* to 103*b*, which can be magnetically coupled. The fasteners 61 to 63 serve to join each of the extension portions 11 to 13 and the outer peripheral core 20 to each other.

Figure 7:
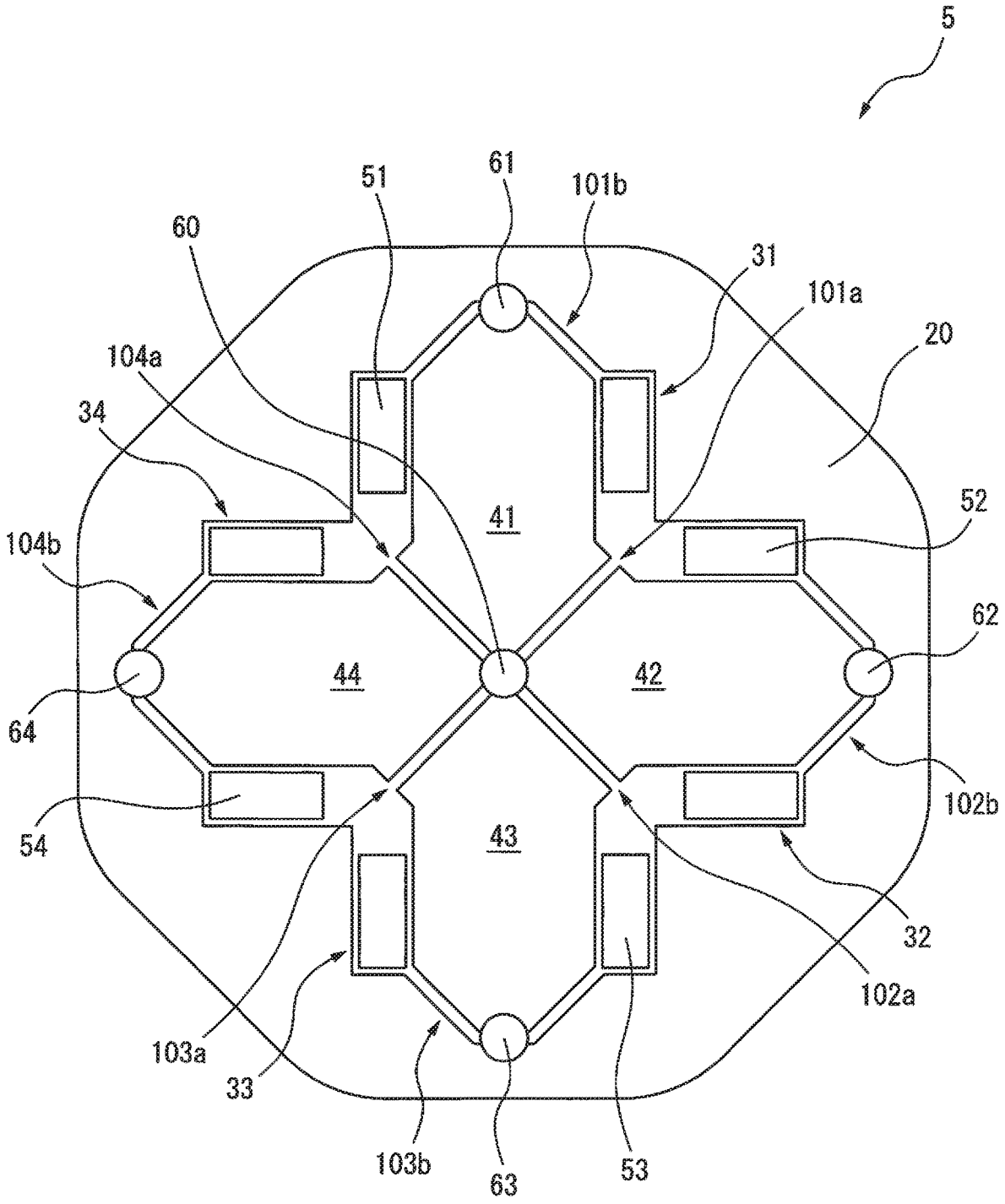
FIG. 7 is a cross-sectional view of yet another reactor including an iron core.

FIG. 7 is a cross-sectional view of yet another reactor including an iron core. As shown in FIG. 7, the reactor 5 includes an approximately octagonal outer peripheral core 20 and four core coils 31 to 34, which are similar to the above-described core coils, disposed inside the outer peripheral core 20. The core coils 31 to 34 are arranged at equal intervals in the circumferential direction of the reactor 5. The number of cores is preferably an even number of 4 or more, and thereby the reactor 5 can be used as a single-phase reactor.

As is apparent from the drawing, the core coils 31 to 34 include cores 41 to 44 and coils 51 to 54 wound onto the cores 41 to 44, respectively. Gaps 101*b* to 104*b* are each formed between the radial outer end portion of each of the cores 41 to 44 and the outer peripheral core 20, so as to be magnetically coupled.

Furthermore, the radial inner end portion of each of the cores 41 to 44 is disposed in the vicinity of the center of the outer peripheral core 20. In FIG. 7, the cores 41 to 44 converge toward the center of the outer peripheral core 20 at their radial inner end portions, each having an edge angle of approximately 90°. The radial inner end portions of the cores

41 to 44 are separated from each other by gaps 101*a* to 104*a*, which can be magnetically coupled.

Fasteners 61 to 64 are each disposed between each of the cores 41 to 44 and the outer peripheral core 20. The centers of the fasteners 61 to 64 are disposed in the gaps 101*b* to 104*b*, which can be magnetically coupled, respectively. The fasteners 61 to 64 serve to loin each of the cores 41 to 44 and the outer peripheral core 20 to each other. Furthermore, a fastener 60 is disposed at the center of the reactor 5. The center of the fastener 60 is disposed at the intersection of the gaps 101*a* to 104*a*. The fastener 60 serves to join the cores 41 to 44 to each other. The embodiments illustrated in FIGS. 6 and 7 produce the same effects as above.

The reactors 5 are described with reference to the drawings, but this disclosure includes potential transformers having the same structure as above. Furthermore, this disclosure includes appropriate combinations of some of the above-described embodiments.

Aspects of the Disclosure

A first aspect provides an iron core that includes a first iron core block (B1) and a second iron core block (B2) disposed so as to create a gap (100) therebetween; and a non-magnetic fastener (65) disposed in the gap, for joining the first iron core block and the second iron core block to each other.

According to a second aspect, in the first aspect, a recessed portion (75) corresponding to the fastener is formed in at least one of the first iron core block and the second iron core block.

According to a third aspect, in the first or second aspect, at least one of part of the first iron core block facing the gap and part of the second iron core block facing the gap includes a gap extension portion (81) for extending the gap.

A fourth aspect further includes an anti-rotation member (76, 77) for preventing rotation of the fastener in the gap, in any one of the first to third aspects.

According to a fifth aspect, in any one of the first to fourth aspects, a plurality of the second iron core blocks are disposed inside the first iron core block of a ring shape, and a coil is wound onto each of the second iron core blocks.

According to a sixth aspect, in the fifth aspect, the number of the second iron core blocks having the coils wound thereon is an integral multiple of 3.

According to a seventh aspect, in the fifth aspect, the number of the second iron core blocks having the coils wound thereon is an even number of 4 or more.

Advantageous Effects of the Aspects

According to the first aspect, the fastener that loins the first iron core block and the second iron core block to each other prevents an increase in noise, vibration, and iron loss. The iron core blocks need not be machined in a specific manner, and therefore produce no effect on inductance.

The second aspect allows the use of a fastener of desired dimensions, irrespective of the dimensions of the gap. Since the recessed portion has a minimum shape corresponding to the fastener, the effect on inductance can be reduced.

When the fastener is disposed, the size of the gap is reduced with respect to the sizes (cross-sectional areas) of the iron core blocks, through which the main magnetic flux passes. The provision of the gap extension portion can compensate for the reduced size of the gap in the third aspect.

According to the fourth aspect, the anti-rotation member prevents rotation of the fastener. This prevents the loosening of the fastener. The anti-rotation member is preferably, for example, a projection, and the anti-rotation member may include a pit for receiving the projection. The anti-rotation member may be provided in the fastener, the first iron core block, or the second iron core block.

According to the fifth aspect, the iron core can be used in a reactor.

According to the sixth aspect, the iron core can be used in a three-phase reactor.

According to the seventh aspect, the iron core can be used in a single-phase reactor.

The present invention has been described above with reference to the preferred embodiments, but it is apparent for those skilled in the art that the above modifications and various other modifications, omissions, and additions can be performed without departing from the scope of the present invention.

What is claimed is:

1. An iron core, comprising:

an outer peripheral core;

at least three iron cores arranged inside the outer peripheral core which extend only in the radial direction of the outer peripheral core, wherein gaps, which can be magnetically coupled, are formed between one of the at least three iron cores and another iron core adjacent thereto, and between the at least three iron cores and the outer peripheral core, and the outer peripheral core and the at least three iron cores are formed by stacking a plurality of iron sheets, carbon steel sheets, electromagnetic steel sheets, or amorphous sheets in the stacking direction; and non-magnetic fasteners for joining, in the stacking direction, between the at least three iron cores as well as between the outer peripheral core and the at least three iron cores.

2. An iron core, comprising:

an outer peripheral core;

a central core arranged inside the outer peripheral core and which is provided with at least three extension portions which extend in only the radial direction of the outer peripheral core, wherein gaps, which can be magnetically coupled, are formed between the outer peripheral core and the at least three extension portions, and the outer peripheral core is formed by stacking a plurality of iron sheets, carbon steel sheets, electromagnetic steel sheets, or amorphous sheets in the stacking direction; and non-magnetic fasteners for joining, in the stacking direction, between the outer peripheral core and the at least three extension, wherein a radially outer end of each extension portion includes two inclined portions and an outermost portion located between the two inclined portions, and an area between the two inclined portions and an inner surface of the outer peripheral core and an area between the outermost portion and an inner surface of the outer peripheral core are parallel to each other.

3. An iron core, comprising:

a first iron core block and a second iron core block disposed so as to create a gap therebetween; and a non-magnetic fastener disposed in the gap and joining the first iron core block and the second iron core block to each other, the non-magnetic fastener including a plurality of screws each including a head portion and a screw portion having outer threads on an outer surface of the screw portion, and a shaft having inner threads that engage the outer threads of the screw portion, wherein a maximum turning radius of a cross-section of the shaft of the non-magnetic fastener is equal to half a gap length of the gap.

4. The iron core according to claim 3, wherein a recessed portion corresponding to the fastener is formed in at least one of the first iron core block and the second iron core block.

5. The iron core according to claim 3, wherein at least one of a part of the first iron core block facing the gap and a part of the second iron core block facing the gap includes a gap extension portion for extending the gap in the part.

6. The iron core according to claim 3, further comprising an anti-rotation member for preventing rotation of the fastener in the gap.

7. The iron core according to claim 3, comprising:

an outer peripheral core;

at least three iron cores arranged inside the outer peripheral core which extend only in the radial direction of the outer peripheral core, wherein gaps, which can be magnetically coupled, are formed between one of the at least three iron cores and another iron core adjacent thereto, as well as between the at least three iron cores and the outer peripheral core, and the outer peripheral core and the at least three iron cores are formed by stacking a plurality of iron sheets, carbon steel sheets, electromagnetic steel sheets, or amorphous sheets in the stacking direction; and non-magnetic fasteners for joining, in the stacking direction, between the at least three iron cores as well as between the outer peripheral core and the at least three iron cores.

8. The iron core according to claim 1, wherein the number of the at least three iron cores is an integral multiple of 3.

9. The iron core according to claim 1, wherein the number of the at least three iron cores is an even number of 4 or more.

10. The iron core according to claim 3, comprising:

an outer peripheral core;

a central core arranged inside the outer peripheral core and which is provided with at least three extension portions which extend in only the radial direction of the outer peripheral core, wherein gaps, which can be magnetically coupled, are formed between the outer peripheral core and the at least three extension portions, and the outer peripheral core is formed by stacking a plurality of iron sheets, carbon steel sheets, electromagnetic steel sheets, or amorphous sheets in the stacking direction; and non-magnetic fasteners for joining, in the stacking direction, between the outer peripheral core and the at least three extensions.

11. The iron core according to claim 2, wherein the number of the at least three iron cores is an integral multiple of 3.

12. The iron core according to claim 2, wherein the number of the at least three iron cores is an even number of 4 or more.

* * * * *